US006717080B1

(12) United States Patent
Chan et al.

(10) Patent No.: US 6,717,080 B1
(45) Date of Patent: Apr. 6, 2004

(54) POWER TOOL TRIGGER ASSEMBLY

(75) Inventors: Kai Chi Chan, Chaiwan (HK); Man Ting Ho, Chaiwan (HK)

(73) Assignee: Defond Components Limited, Chaiwan (HK)

( * ) Notice: Subject to any disclaimer, the term of this patent is extended or adjusted under 35 U.S.C. 154(b) by 0 days.

(21) Appl. No.: 10/443,060

(22) Filed: May 22, 2003

(51) Int. Cl.[7] ..... H01H 29/16
(52) U.S. Cl. ..... 200/200; 200/334; 200/42.01
(58) Field of Search ..... 200/200, 42.01, 200/330, 332, 334, 335, 61.85

(56) References Cited

U.S. PATENT DOCUMENTS 3,780,246 A * 12/1973 Beckering et al. ..... 200/43.17
4,122,320 A * 10/1978 Edgell et al. ..... 200/43.17
4,244,406 A * 1/1981 Stielper ..... 144/136.95
4,276,459 A * 6/1981 Willett et al. ..... 200/43.17
4,922,069 A * 5/1990 Huizenga ..... 200/334
5,316,382 A * 5/1994 Penaranda et al. ..... 366/129
5,988,241 A * 11/1999 Bosten et al. ..... 144/154.5
6,153,838 A * 11/2000 Wadge ..... 200/50.01

* cited by examiner

*Primary Examiner*—K. Lee
(74) *Attorney, Agent, or Firm*—Leydig, Voit & Mayer, Ltd.

(57) ABSTRACT

A trigger assembly for an electric power tool including a motor comprises a base for fixing within the power tool and a trigger supported by the base for inward and outward movement. A mechanical switch in the base switches on and off the motor. An operating circuitry including a solid-state device in the base controls the motor when the switch is closed. A slider guided within the base for movement by the trigger operates the switch and the operating circuitry. The switch has a fixed contact, a moving contact pivotable into contact with and out of contact from the fixed contact, and a spring biassing the moving contact towards the closed position. The moving contact has a first end for contacting the fixed contact and a second end for engagement by the slider to cause pivoting of the moving contact to the open position. Two such switches are used as main and bypass switches, with their moving contacts supported by a common conductive support together forming a switch module to facilitate installation.

24 Claims, 7 Drawing Sheets

POWER TOOL TRIGGER ASSEMBLY

The present invention relates to a trigger assembly for an electric power tool, and to a switch module particularly but not exclusively for use in the trigger assembly.

BACKGROUND OF THE INVENTION

The operation of an electric hand drill is typically controlled by means of a pull-trigger, which is used to switch on and off the motor as well as to adjust its speed/torque during operation. As the switch for switching the motor needs to handle a large inductive current, its construction is under stringent requirements in terms of switching time and contact pressure, for example, on one hand and simplicity and compactness on the other hand.

In a conventional construction of the switch, a flat-V-shaped moving contact is pivoted about its apex and acted upon on its inner surface by a spring-loaded plunger. The plunger is laterally slidable along the inner contact surface across the apex, thereby rocking the contact into contact with or out of contact from a fixed contact. Such a switch construction is found to be unsatisfactory in terms of the aforesaid requirements, as the spring action shifts relative to the moving contact. Also, the switch is cumbersome to install, especially within the confined space in the body of the pull-trigger.

The invention seeks to mitigate or at least alleviate such a problem by providing a trigger assembly for an electric power tool.

SUMMARY OF THE INVENTION

According to a first aspect of the invention, there is provided a trigger assembly for controlling the operation of an electric power tool including an electric motor. The assembly has a base for fixing within the power tool and a trigger supported by the base for inward and outward movement relative to the power tool. A mechanical switch in the base is operable to switch on and off the motor. An electronic operating circuitry including a solid-state device in the base controls the operation of the motor when the switch is closed. A slider is guided within the base for movement by or with the trigger to operate the switch and the operating circuitry. The switch has a fixed contact, a moving contact pivoted for movement between a first position in contact with the fixed contact and a second position out of contact therefrom, and resilient means biassing the moving contact towards the first position. The moving contact has a first end for contacting the fixed contact and a second end for engagement by the slider to cause pivoting of the moving contact to the second position against the action of the resilient means.

Preferably, the trigger is resiliently biassed towards an outermost home position, and the switch is open when the trigger is in the home position and will be closed when the trigger is moved away from the home position.

More preferably, the switch is closed immediately after the trigger has moved away from the home position and will remain closed thereafter until the trigger returns substantially to the home position.

In a specific construction, the moving contact is pivoted by a stationary conductive support, and the resilient means co-acts between the moving contact and the support.

More specifically, the moving contact is supported adjacent its second end by the support, and the resilient means acts upon the moving contact at about its mid-length.

It is preferred that the slider has a part extending substantially parallel to the direction of movement of the slider for slidably engaging the second end of the moving contact to close the switch.

It is further preferred that the slider part has a surface for slidably engaging the second end of the moving contact, and the surface is discontinuous to minimise the risk of breakdown or flashover therealong.

It is yet further preferred that the slider part surface includes a groove.

In a preferred embodiment, the trigger assembly includes a second mechanical switch in the base connected in parallel with the solid-state device and operable by the slider at or adjacent an innermost position of the trigger to close and thus bypass the solid-state device. The second switch has a fixed contact, a moving contact pivoted for movement between a first position in contact with the fixed contact and a second position out of contact therefrom, and resilient means biassing the moving contact towards the first position. The moving contact has a first end for contacting the fixed contact and a second end for engagement by the slider to cause pivoting of the moving contact to the second position against the action of the resilient means.

Preferably, the trigger is resiliently biassed towards an outermost home position, and the first switch is open when the trigger is in the home position and will be closed when the trigger is moved away from the home position.

It is preferred that both moving contacts are pivoted by a common stationary conductive support, and each resilient means co-acts between the corresponding moving contact and the support.

Preferably, the slider has a first part extending substantially parallel to the direction of movement of the slider for slidably engaging the second end of the moving contact of the first switch to close the first switch. The slider includes a second part on one side of the first part for slidably engaging the second end of the moving contact of the second switch to close the second switch. The second part is shorter than the first part in the direction of outward movement of the trigger.

More preferably, the slider parts have a surface for slidably engaging the second ends of the moving contacts, and the surface is discontinuous to minimise the risk of breakdown or flashover therealong.

Further more preferably, the slider part surface includes a groove.

It is preferred that the first and second switches have substantially the same construction and are operable by the slider in substantially the same manner but at different times according to the moving position of the trigger.

The invention also provides an electric power tool including an electric motor and the aforesaid trigger assembly.

In one example, the electric power tool is an electric hand drill.

According to a second aspect of the invention, there is provided a switch module for use in a controller for controlling the operation of an electric power tool. The switch module comprises two contact levers, each having a first part and a second part along its length, and a common conductive support having an upper portion engaging and supporting the levers by their first parts for individual limited pivotal movement between upper and lower positions and including a lower portion. A spring co-acts between the second part of each lever and the lower portion of the support for resiliently biassing the lever towards the lower position. The spring acts in a direction that reinforces the engagement between the first lever part and the upper support portion such that both levers and the support together form a unitary module. One of the lever acts as a moving contact of a main switch for switching on and off said power tool, and the other lever acts as a moving contact of a bypass switch for continuously switching on said power tool.

Preferably, the upper portion of the support has two upwardly facing recesses, each engaging therein the first part of a corresponding lever.

More preferably, each recess has a restricted opening narrower than the first part of the corresponding lever for retaining it therein.

Further more preferably, each recess has a laterally inward protrusion restricting the recess opening.

It is preferred that each recess has two opposite sides, and the first part of the corresponding lever has a pair of notches on opposite sides thereof inter-engaging with the respective sides of the recess.

Preferably, each spring comprises an extension coil spring having opposite ends connected to the second part of the corresponding lever and the lower portion of the support respectively.

It is preferred that the lower portion of the support includes an integral extension for electrical connection.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
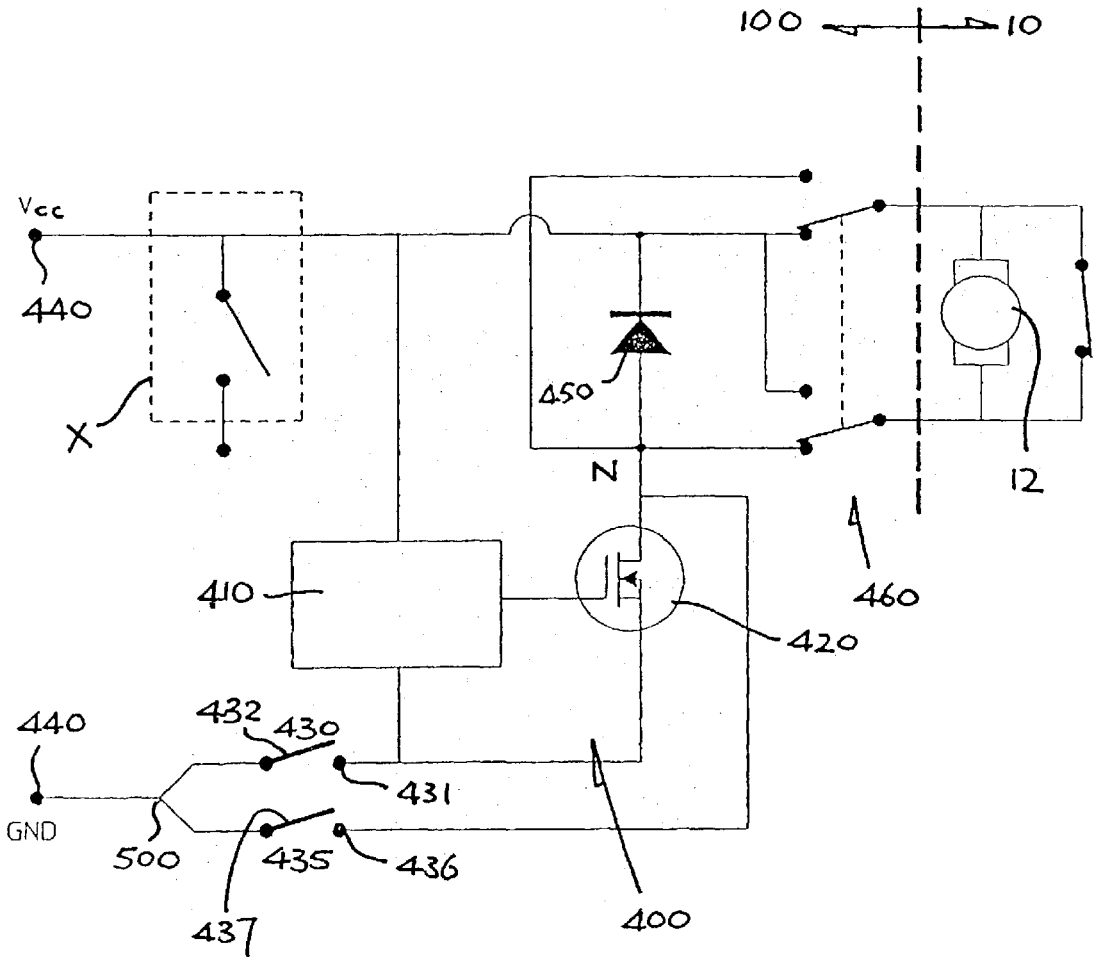
FIG. 1 is a simplified circuit diagram of an embodiment of a trigger assembly in accordance with the invention, connected to an electric power tool incorporating a motor, said assembly including a mechanical switch for switching on and off the motor.

Referring to the drawings, there is shown a trigger assembly 100 embodying the invention for controlling the operation of an electric power tool such as a hand drill 10 that incorporates an electric motor 12. The trigger assembly 100 comprises an upright generally rectangular base 200 fixed inside the drill body adjacent the upper end of its handgrip and a pull-trigger 300 supported by the base 200 for inward (rearward) and outward (forward) horizontal sliding movement. A housing 210 of the base 200 has an upper portion 212 from inside which the pull-trigger 300 extends forwards, and a lower portion 214 housing a pair of mechanical main and bypass switches 430 and 435 respectively for switching the motor 12. Both switches 430 and 435 are operated by the pull-trigger 300 at different times according to the travelling position of the trigger 300.

The trigger assembly 100 incorporates, as contained within its base housing 210, an electronic operating circuitry 400 which comprises an IC control circuit 410 and a solid-state switch 420 controlled by the circuit 410. The solid-state and main switches 420 and 430 are connected in series with the motor 12 across positive (Vcc) and negative (GND) terminals 440 of a rechargeable DC battery pack for the hand drill 10. The bypass switch 435 is connected in parallel with the main and solid-state switches 430 and 420 for bypassing them.

A flywheel diode 450 and a double-pole double-throw reversal switch 460 are connected across the terminals of the motor 12. The flywheel diode 450 is connected to the motor 12 by the reversal switch 460 only when the reversal switch 460 switches the motor 12 to run in the forward direction.

In use, the main switch 430 switches on the motor 12 upon (or shortly after) pulling back of the pull-trigger 300 from its initial foremost (outermost) home position and later switches it off when the pull-trigger 300 returns to its home position. While the main switch 430 is closed, the solid-state switch 420 controls the operation of the motor 12. The control circuit 410 comes into operation upon closing of the main switch 430, whereupon it triggers the solid-state switch 420 to switch on and off at a relatively high frequency, having a variable duty cycle according to the travelling position of the pull-trigger 300 for adjusting the speed/torque of the motor 12. The flywheel diode 450 allows the motor current to continue to flow while the solid-state switch 420 is non-conducting during switching.

The bypass switch 435 is connected from the negative (GND) battery terminal 440 to a circuit node N immediately beyond the solid-state switch 420. The bypass switch 435 will be closed when the pull-trigger 300 is (almost) fully pulled back to a rearmost (innermost) position for bypassing the solid-state switch 420 in particular, thereby delivering full power directly to the motor 12 for maximum speed/torque operation.

The pull-trigger 300 has a body 310 exposed for manual pulling, a generally rectangular core slider 320 guided within the upper portion 212 of the base housing 210 for back and forth sliding movement, and a horizontal shaft 330 interconnecting the trigger body 310 and slider 320 for simultaneous movement. The core slider 320, which is resiliently biassed forwards from behind by a compression coil spring 322, carries on its right side a four-pronged sliding contact 324.

The contact 324 bears slidably against a row of contact strips on a circuit board mounting the control circuit 410 for selectively making contact therewith, as the slider 320 is pushed inwards by the trigger body 310 or outwards by the spring 322 upon release of the trigger body 310. The sliding position of the contact 324 determines the duty cycle of the trigger signal generated by the control circuit 410 for switching on and off the solid-state switch 420.

The main and bypass switches 430 and 435 are provided side-by-side immediately below the core slider 320 for operation thereby. The slider 320 has a generally horizontal bottom surface profile that provides a pair of downwardly protruding left and right parts acting as cams 326 and 328 for operating the main and bypass switches 430 and 435 respectively. The right cam 328 extends parallel to the direction of movement of the slider 320. The left cam 326 is situated by the side of the right cam 328, and is considerably shorter than the right cam 328 by terminating much earlier in the forward direction of the slider 320.

The main switch 430 has a fixed contact 431 and a moving contact in the form of a pivoted lever 432. The contact lever 432 has a front end 432A for contacting the fixed contact 431 and a rear end 432B crooked upwards for sliding engagement by the left cam 326 of the core slider 320. The fixed contact 431 is connected to the solid-state switch 420 such that the two switches 430 and 420 are connected in series, and to the control circuit 410 for enabling the same.

The bypass switch 435 has a fixed contact 436 and a moving contact in the form of a pivoted lever 437. The contact lever 437 has a front end 437A for contacting the fixed contact 436 and a rear end 437B crooked upwards for sliding engagement by the right cam 328 of the core slider 320. The fixed contact 436 is connected to the circuit node N immediately beyond the solid-state switch 420 for bypassing the same.

Each lever 432/437 has, on opposite sides thereof, a first pair of notches 432C/437C adjacent its rear end 432B/437B and a second pair of notches 432D/437D at about its mid-length. Both contact levers 432 and 437 are supported adjacent their rear ends 432B and 437B for individual limited pivotal movement between upper and lower positions by a common stationary conductive support 500, hence in mutual electrical connection thereto.

The support 500 has an L-shaped body formed by an upper vertical wall 501 and a lower horizontal wall 503. The vertical wall 501 has a pair of top recesses in the form of cutouts 502 acting as pivots engaging therein and locating respective contact levers 432 and 437 by their first notched parts 432C and 437C. The horizontal wall 503 extends in the same direction as the front lever ends 432A and 437A. The support 500 includes an integral extension 504 depending from the horizontal wall 503 and connected to the negative (GND) battery terminal 440.

Each cutout 502 is of an upwardly facing generally rectangular U-shape, having an opening which is slightly restricted by a laterally inward protrusion 502A on one side thereof so that the opening is narrower than the first notched part 432C/437C of the corresponding contact lever 432/437. The restricted opening retains the lever part 432C/437C in the cutout 502.

The lever 432/437 engages with the cutout 502 by being firstly inserted laterally into the cutout 502 at an inclined angle towards its side bearing the protrusion 502A and then laid against its flat bottom, with the notches 432C/437C inter-engaging with respective opposite sides of the cutout 502. The notched lever part 432C/437C lies flat against the bottom of the cutout 502 for good electrical contact with the support 500. The notches 432C/437C have a width only slightly larger than the thickness of the sides of the cutout 502, such that the lever 432/437 can only pivot through a limited angle between the upper and the lower positions.

An extension coil spring 433/438 is stretched across the second notched part 432D/437D of each contact lever 432/437 and the horizontal support wall 503, with its opposite ends connected thereto respectively. The spring 433/438 co-acts between the lever part 432D/437D and the support wall 503 for resiliently biassing the lever 432/437 downwards to slightly below a horizontal position, whereby its front end 432A/437A is resiliently biassed towards contacting the corresponding fixed contact 431/436. Thus, both the main and the bypass switch 430 and 435 are biassed to close.

Figure 3:
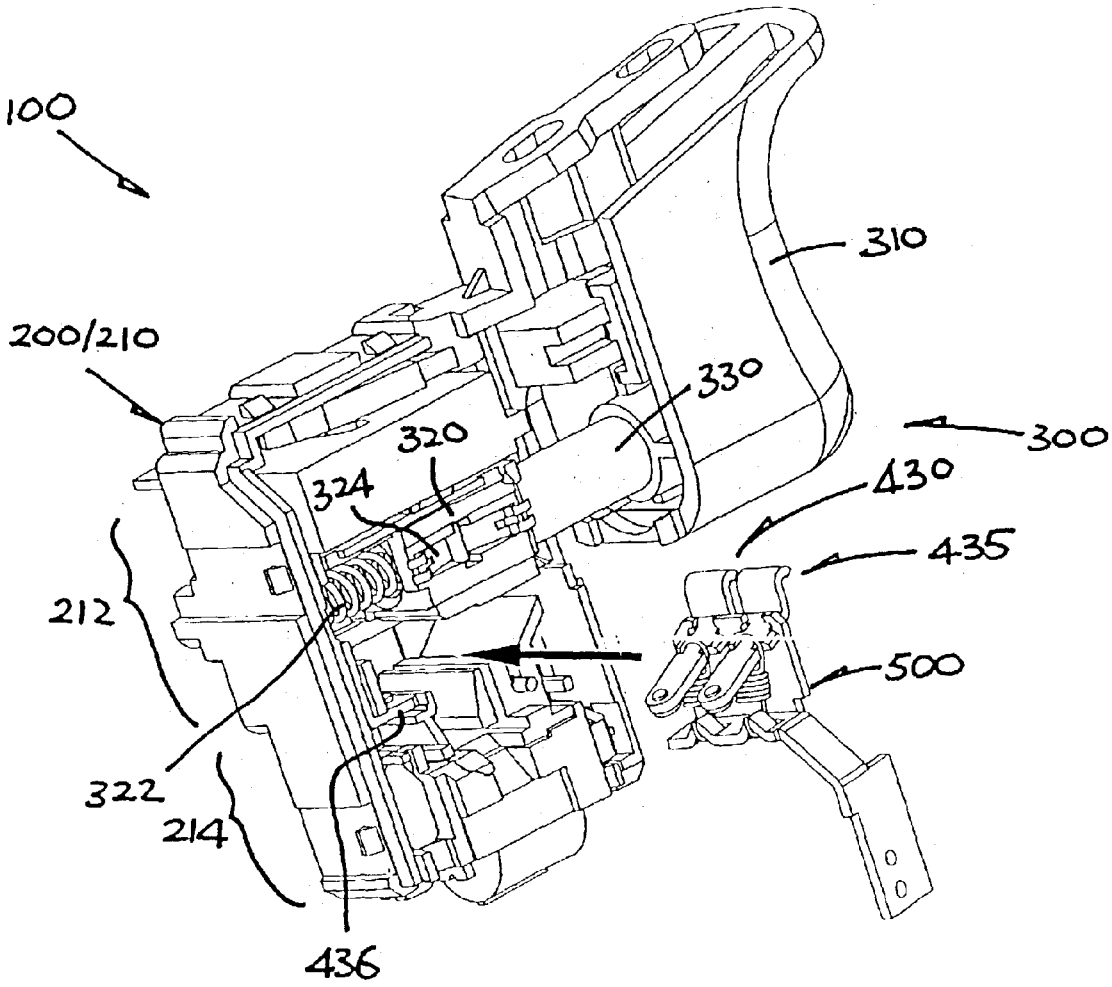
FIG. 3 is a right side perspective view of the trigger assembly of FIG. 2, showing two moving contacts and a conductive support therefor of the switch separated.

Each spring 433/438 acts in a downward direction that reinforces the engagement between the first notched part 432C/437C of the associated lever 432/437 and the corresponding upwardly facing cutout 502 of the vertical support wall 501. The springs 433 and 438 keep both levers 432 and 437 and the support 500 together, thereby forming a unitary module that can be assembled in advance and then simply and conveniently be inserted laterally into the trigger assembly 100 as illustrated in FIG. 3.

Figure 2:
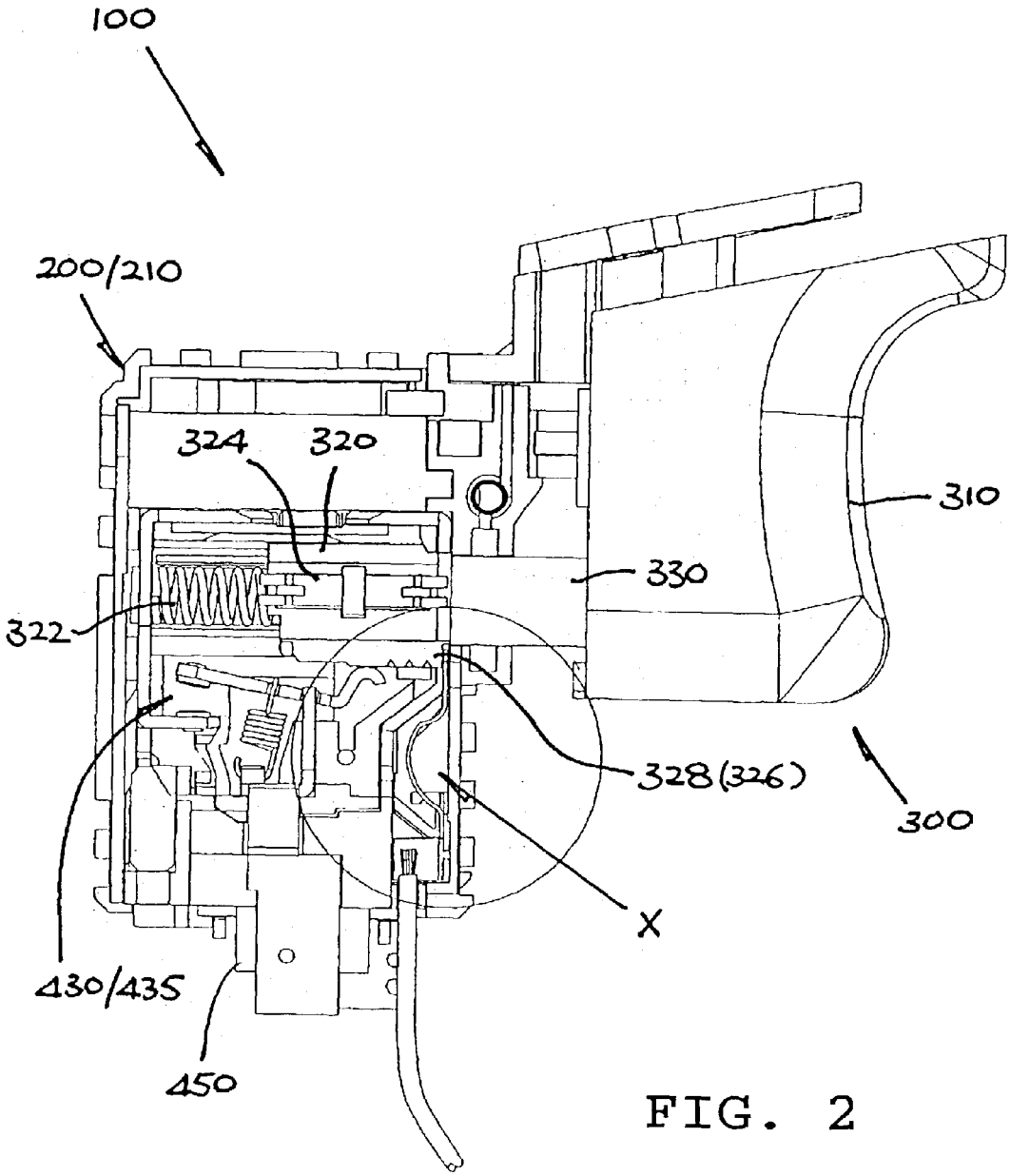
FIG. 2 is a right side elevational view of the trigger assembly of FIG. 1, with a right side wall thereof removed to show the internal details including the switch.

By means of its cams 326 and 328, the core slider 320 is able to act upon the corresponding rear lever ends 432B and 437B against the action of the springs 433 and 438, thereby pivoting the contact levers 432 and 437 upwards. This results in opening of both the main and the bypass switches 430 and 435, which occurs when the pull-trigger 300 is at the home position. Thus, both the main and bypass switches 430 and 435 are normally open (FIG. 2).

As the pull-trigger 300 is initially pulled back from the home position, the core slider 320 slides simultaneously rearwards with its left cam 326 immediately moving away from the rear lever end 432B of the main switch 430. Upon disengagement of the cam 326 from the rear lever end 432B, the contact lever 432 is released to pivot downwards under the action of the spring 433, whereby the main switch 430 is closed and the motor 12 starts to run. The main switch 430 will remain closed until the trigger 300 returns substantially to the home position.

Figure 4:
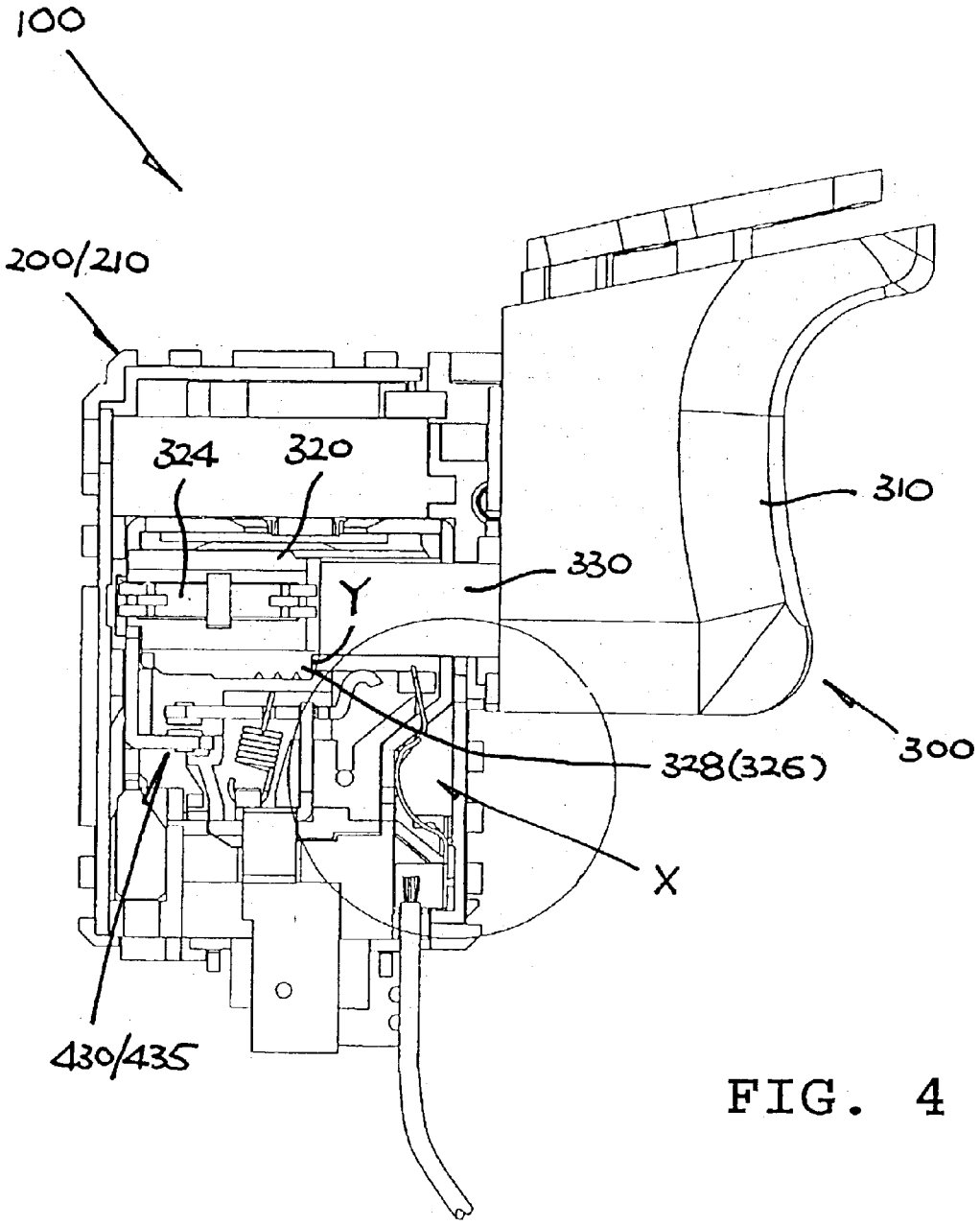
FIG. 4 is a right side elevational view corresponding to FIG. 2, showing the trigger assembly in operation.
Figure 5:
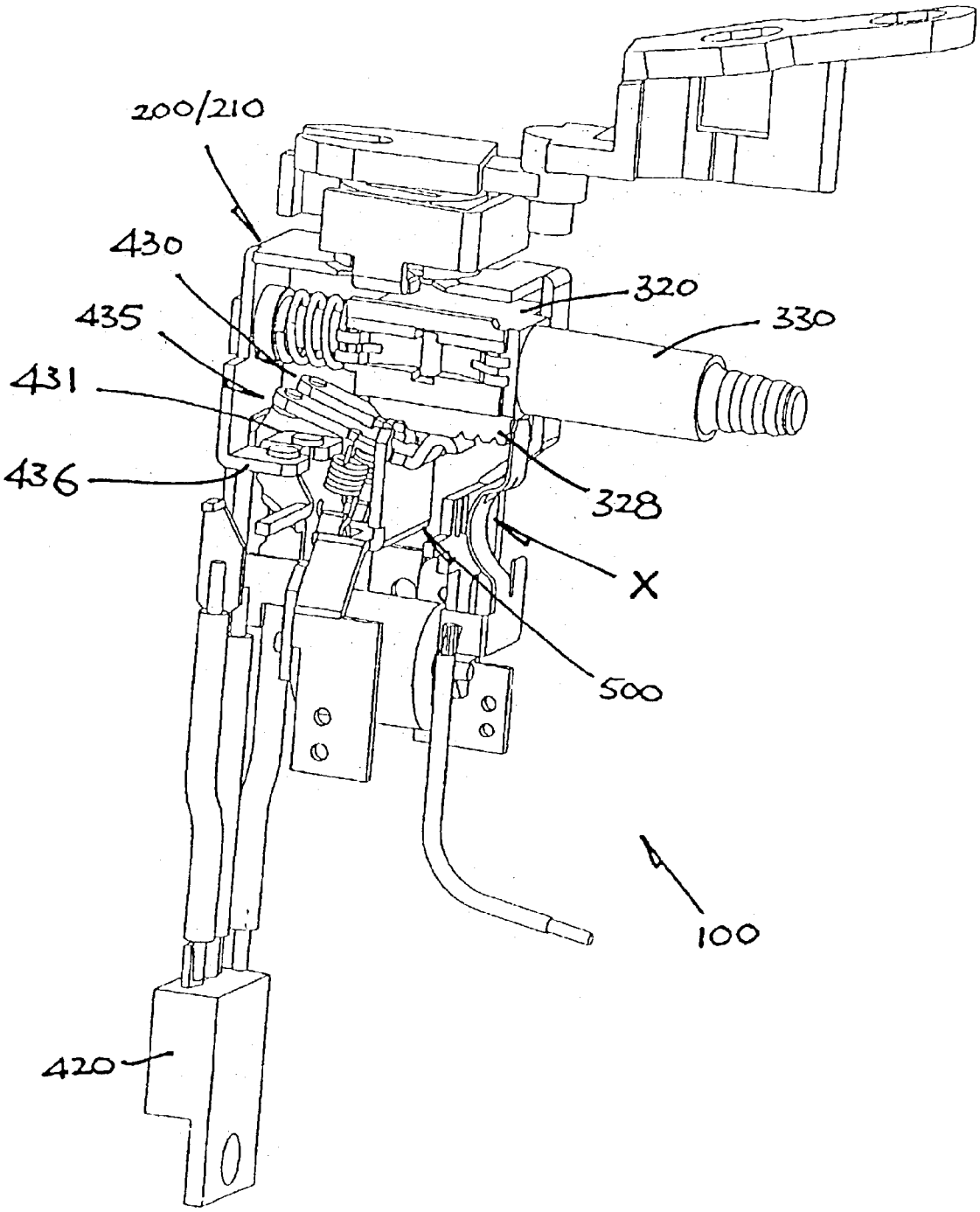
FIG. 5 is another right side perspective view of the trigger assembly of FIG. 2, showing the switch more clearly.
Figure 6:
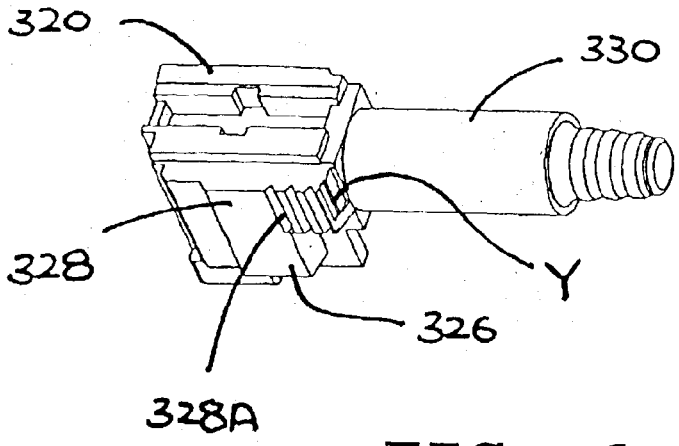
FIG. 6 is a bottom perspective view of a slider of the trigger assembly of FIG. 2, for operating the switch.
Figure 7:
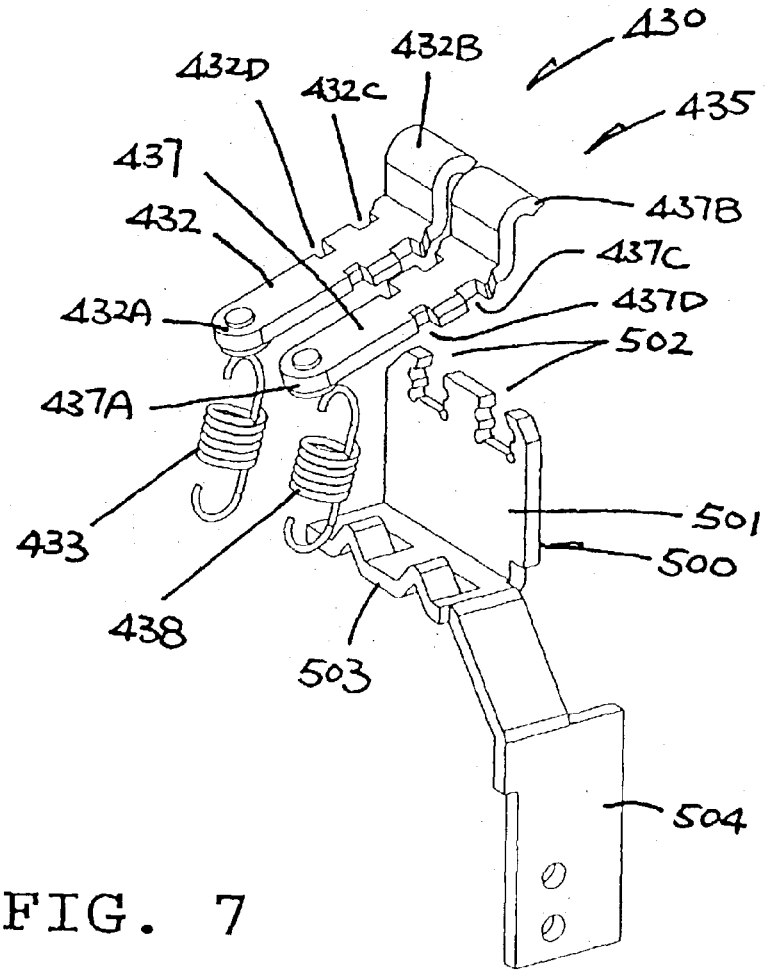
FIG. 7 is an exposed right side perspective view of the moving contacts and support of FIG. 3.
Figure 8:
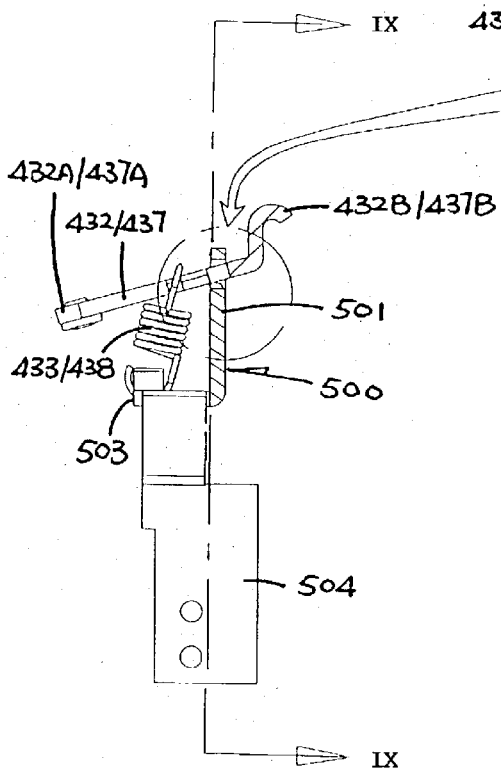
FIG. 8 is a partially cross-sectioned right side view, of the moving contacts and support of FIG. 7, said moving contacts being in a lower position.
Figure 8A:
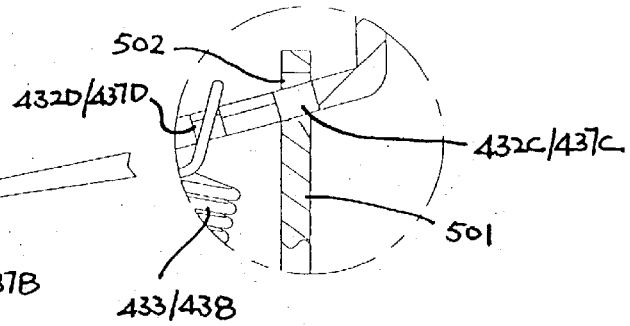
FIG. 8A is an enlarged view of part of the moving contacts and support of FIG. 8.
Figure 9A:
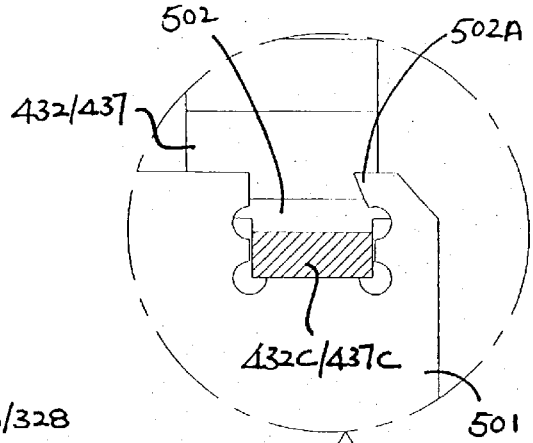
FIG. 9A is an enlarged view of part of the moving contacts and support of FIG. 9.
Figure 10:
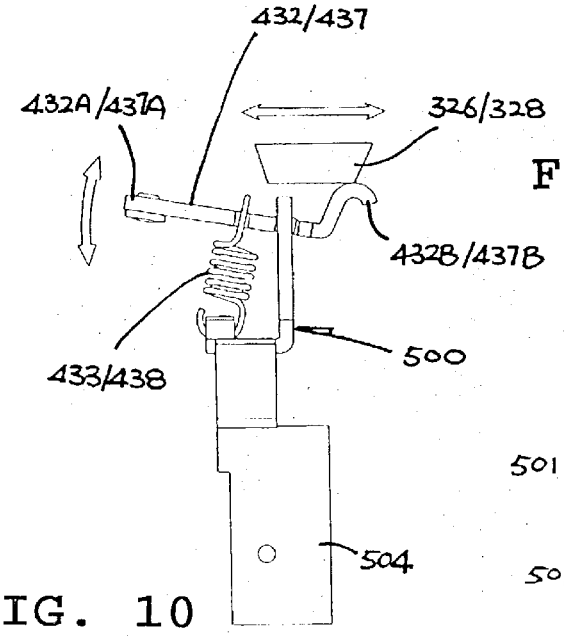
FIG. 10 is a right side elevational view corresponding to FIG. 8, illustrating how the moving contacts are moved to an upper position by the slider of FIG. 6.
Figure 9:
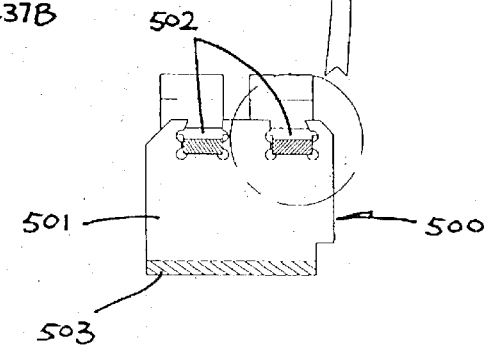
FIG. 9 is a fragmentary cross-sectional view of the moving contacts and support of FIG. 8, taken along line IX—IX.

Upon continual pulling back of the pull-trigger 300, the core slider 320 will reach near the rearmost position, with its right cam 328 moving off and thus disengaging from the rear lever end 437B of the bypass switch 435. Upon release, the contact lever 437 is pivoted downwards by the spring 438, whereby the bypass switch 435 is also closed to deliver full power directly to the motor 12. The bypass switch 435 will remain closed for as long as the trigger 300 is substantially fully pulled back (FIG. 4).

Upon release of the pull-trigger 300, the core slider 320 will return from the rearmost position to the home position under the action of the spring 322. Initially, the slider right cam 328 engages the rear lever end 437B and pivots the contact lever 437 upwards against the action of the spring 438, whereby the bypass switch 435 is opened and the solid-state switch 420 takes control. As the slider 320 almost reaches the home position, its left cam 326 engages the rear lever end 432B and pivots the contact lever 432 upwards against the spring 433, whereby the main switch 430 is also opened to stop the motor 12.

As described in a related utility patent application entitled "Power Tool Trigger Assembly" filed on the same day in the name of the same inventors under Attorney Docket No. 402646, the disclosure thereof is hereby incorporated by reference, the trigger assembly 100 includes a built-in mechanical switch X for controlling certain auxiliary electronic or electrical devices for the power tool, such as battery and level meters. This built-in switch X is also operated by the pull-trigger 300, and more specifically by a free end Y of the right cam 328 of the core slider 320. The lower surface of the cams 326 and 328 taken as a whole, over a relatively short region thereof adjacent or leading to the free end Y, is formed with a series of three grooves 328A. The grooves 328A run transversely (or at an acute angle) across the complete width of this region, thereby interrupting the surface to render it discontinuous or lengthen its surface length over this region.

During operation, as the contact levers 432 and 437 always bear and rub, with their rear ends 432B and 437B, against the lower surface of the cams 326 and 328, a small amount of their conductive material will in the course of time be transferred to the cam surface. As the material builds up on the cam surface particularly over the said region adjacent or leading to the free end Y, a conductive surface path will inevitably be formed. In an extreme or faulty condition, the conductive path is prone to breakdown or flashover between the conducting parts of the main/bypass switch 430/435 and built-in switch X, thereby damaging the auxiliary devices. The grooves 328A minimise the risk of such breakdown or flashover by interrupting the surface of this path or extending its surface length.

Each main/bypass switch 430/435 includes a moving contact 432/437 biassed by a spring 433/438 to come into contact with the fixed contact 431/436. Upon release, the moving contact 432/437 instantly snaps into contact with the fixed contact 431/436 by action of the spring 433/438, with the spring then maintaining the contact at a constant force. Hence, the contact pressure and the switching time, and in particular the switching-on time, can be predefined with precision and achieved during operation. The contact pressure should be adequate for good contact, and the switching time relative to the position of the trigger body 310 should be accurate so that switching will always occur at the same trigger position.

Both the main and the bypass switches 430 and 435 make use of identical moving contact levers 432 and 437 and identical springs 433 and 438, and are implemented as a double switch sharing a common support 500 for the levers 432 and 437. This achieves simplicity in construction and compactness in size, as well as ease of assembling. The contact levers 432 and 437 and conductive support 500 therefor constitute a unitary module that may be used in any other types of power tool controller.

The subject trigger assembly may be utilized to control any other types of electric power tools, such as a reamer, cutter or saw. It is envisaged that the coil springs 433 and 438 may take any other forms, or may be replaced by inherent resilience of the moving contacts 432 and 437 if they are made or arranged to be flexible.

The invention has been given by way of example only, and various other modifications of and/or alterations to the described embodiment may be made by persons skilled in the art without departing from the scope of the invention as specified in the appended claims.

What is claimed is:

1. A trigger assembly for controlling the operation of an electric power tool including an electric motor, comprising:

a base for fixing within said power tool;

a trigger supported by the base for inward and outward movement relative to said power tool;

a mechanical switch in the base and operable to switch on and off said motor;

an electronic operating circuitry including a solid-state device in the base for controlling the operation of said motor when the switch is closed; and a slider guided within the base for movement by or with the trigger to operate the switch and the operating circuitry;

wherein the switch comprises a fixed contact, a moving contact pivoted for movement between a first position in contact with the fixed contact and a second position out of contact therefrom, and resilient means biassing the moving contact towards the first position, the moving contact having a first end for contacting the fixed contact and a second end for engagement by the slider to cause pivoting of the moving contact to the second position against the action of the resilient means.

2. The trigger assembly as claimed in claim 1, wherein the trigger is resiliently biassed towards an outermost home position, and the switch is open when the trigger is in the home position and will be closed when the trigger is moved away from the home position.

3. The trigger assembly as claimed in claim 2, wherein the switch is closed immediately after the trigger has moved away from the home position and will remain closed thereafter until the trigger returns substantially to the home position.

4. The trigger assembly as claimed in claim 1, wherein the moving contact is pivoted by a stationary conductive support, and the resilient means co-acts between the moving contact and the support.

5. The trigger assembly as claimed in claim 4, wherein the moving contact is supported adjacent its second end by the support, and the resilient means acts upon the moving contact at about its mid-length.

6. The trigger assembly as claimed in claim 1, wherein the slider has a part extending substantially parallel to the direction of movement of the slider for slidably engaging the second end of the moving contact to close the switch.

7. The trigger assembly as claimed in claim 6, wherein the slider part has a surface for slidably engaging the second end of the moving contact, and the surface is discontinuous.

8. The trigger assembly as claimed in claim 7, wherein the slider part surface includes a groove.

9. The trigger assembly as claimed in claim 1, including a second mechanical switch in the base connected in parallel with the solid-state device and operable by the slider at or adjacent an innermost position of the trigger to close and thus bypass the solid-state device, wherein the second switch comprises a fixed contact, a moving contact pivoted for movement between a first position in contact with the fixed contact and a second position out of contact therefrom, and resilient means biassing the moving contact towards the first position, the moving contact having a first end for contacting the fixed contact and a second end for engagement by the slider to cause pivoting of the moving contact to the second position against the action of the resilient means.

10. The trigger assembly as claimed in claim 9, wherein the trigger is resiliently biassed towards an outermost home position, and the first switch is open when the trigger is in the home position and will be closed when the trigger is moved away from the home position.

11. The trigger assembly as claimed in claim 9, wherein both moving contacts are pivoted by a common stationary conductive support, and each resilient means co-acts between the corresponding moving contact and the support.

12. The trigger assembly as claimed in claim 9, wherein the slider has a first part extending substantially parallel to the direction of movement of the slider for slidably engaging the second end of the moving contact of the first switch to close the first switch, and includes a second part on one side of the first part for slidably engaging the second end of the moving contact of the second switch to close the second switch, the second part being shorter than the first part in the direction of outward movement of the trigger.

13. The trigger assembly as claimed in claim 12, wherein the slider parts have a surface for slidably engaging the second ends of the moving contacts, and the surface is discontinuous.

14. The trigger assembly as claimed in claim 13, wherein the slider part surface includes a groove.

15. The trigger assembly as claimed in claim 9, wherein the first and second switches have substantially the same construction and are operable by the slider in substantially the same manner but at different times according to the moving position of the trigger.

16. An electric power tool including an electric motor and the trigger assembly as claimed in claim 1.

17. The electric power tool as claimed in claim 16, being an electric hand drill.

18. A switch module for use in a controller for controlling the operation of an electric power tool, comprising:

two contact levers, each having a first part and a second part along its length;

a common conductive support having an upper portion engaging and supporting the levers by their first parts for individual limited pivotal movement between upper and lower positions and including a lower portion; and a spring co-acting between the second part of each lever and the lower portion of the support for resiliently biassing the lever towards the lower position, the spring acting in a direction that reinforces the engagement between the first lever part and the upper support portion such that both levers and the support together form a unitary module;

one of the levers acting as a moving contact of a main switch for switching on and off said power tool, and the other lever acting as a moving contact of a bypass switch for continuously switching on said power tool.

19. The switch module as claimed in claim 18, wherein the upper portion of the support has two upwardly facing recesses, each engaging therein the first part of a corresponding lever.

20. The switch module as claimed in claim 19, wherein each recess has a restricted opening narrower than the first part of the corresponding lever for retaining it therein.

21. The switch module as claimed in claim 20, wherein each recess has a laterally inward protrusion restricting the recess opening.

22. The switch module as claimed in claim 19, wherein each recess has two opposite sides, and the first part of the corresponding lever has a pair of notches on opposite sides thereof inter-engaging with the respective sides of the recess.

23. The switch module as claimed in claim 18, wherein each spring comprises an extension coil spring having opposite ends connected to the second part of the corresponding lever and the lower portion of the support respectively.

24. The switch module as claimed in claim 18, wherein the lower portion of the support includes an integral extension for electrical connection.

* * * * *